US008860533B2

(12) United States Patent
Chou

(10) Patent No.: US 8,860,533 B2
(45) Date of Patent: Oct. 14, 2014

(54) LOW PASS FILTER

(75) Inventor: Hsuan-Ta Chou, Tu-Cheng (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 696 days.

(21) Appl. No.: 13/041,449

(22) Filed: Mar. 7, 2011

(65) Prior Publication Data

US 2012/0194299 A1 Aug. 2, 2012

(30) Foreign Application Priority Data

Jan. 27, 2011 (CN) ..... 2011 1 10029362

(51) Int. Cl.
*H01P 1/203* (2006.01)
*H01P 7/08* (2006.01)

(52) U.S. Cl.
CPC ..... *H01P 1/2039* (2013.01); *H01P 7/082* (2013.01)
USPC ..... 333/204; 333/219

(58) Field of Classification Search
CPC ..... H01P 1/2039; H01P 7/082
USPC ..... 333/204, 205, 219, 235, 32, 33
See application file for complete search history.

(56) References Cited

U.S. PATENT DOCUMENTS

| | | | | |
|---|---|---|---|---|
| 7,215,218 | B2 * | 5/2007 | Burns et al. | 333/26 |
| 2002/0008598 | A1 * | 1/2002 | Huang et al. | 333/33 |
| 2002/0163405 | A1 * | 11/2002 | Miyazaki et al. | 333/204 |
| 2008/0117004 | A1 * | 5/2008 | Mochizuki | 333/204 |

FOREIGN PATENT DOCUMENTS

CN 01800764.3 8/2002

OTHER PUBLICATIONS

Chen et al, "Compact Microstrip Lowpass Filter Using Slow-Wave Resonator", 2005, IEEE.*

* cited by examiner

*Primary Examiner* — Benny Lee
*Assistant Examiner* — Gerald Stevens
(74) *Attorney, Agent, or Firm* — Novak Druce Connolly Bove + Quigg LLP

(57) ABSTRACT

A low pass filter includes a signal transmission line, a first open stub, a second open stub, a first coupling line, and a second coupling line. The signal transmission line is connected between a first port and a second port, and operable to transmit RF signals from the first port to the second port. The signal transmission line defines a first side and a second side opposite to the first side. The first open stub and the second stub are disposed on the first side and perpendicularly connected to the signal transmission line. The second open stub and the first open stub co-define a T-shaped gap. The first coupling line is parallel to the signal transmission line and disposed in the T-shaped gap. The second coupling line is parallel to the signal transmission line and disposed on the second side of the signal transmission line.

16 Claims, 11 Drawing Sheets

LOW PASS FILTER

BACKGROUND

1. Technical Field

The present disclosure relates to filters, and more particularly to a low pass filter.

2. Description of Related Art

Filters are key components in an electronic signal processing system, and are used to pass desirable signals and filter interference signals. During circuit designs, a low pass filter is often placed after a transmission amplifier in order to filter a second harmonic and a third harmonic of the transmission amplifier.

However, it is a big challenge how to design a low pass filter that can effectively filter the second harmonic and the third harmonic.

BRIEF DESCRIPTION OF THE DRAWINGS

The details of the disclosure, both as to its structure and operation, can best be understood by referring to the accompanying drawing, in which like reference numbers and designations refer to like elements.

DETAILED DESCRIPTION

Figure 1:
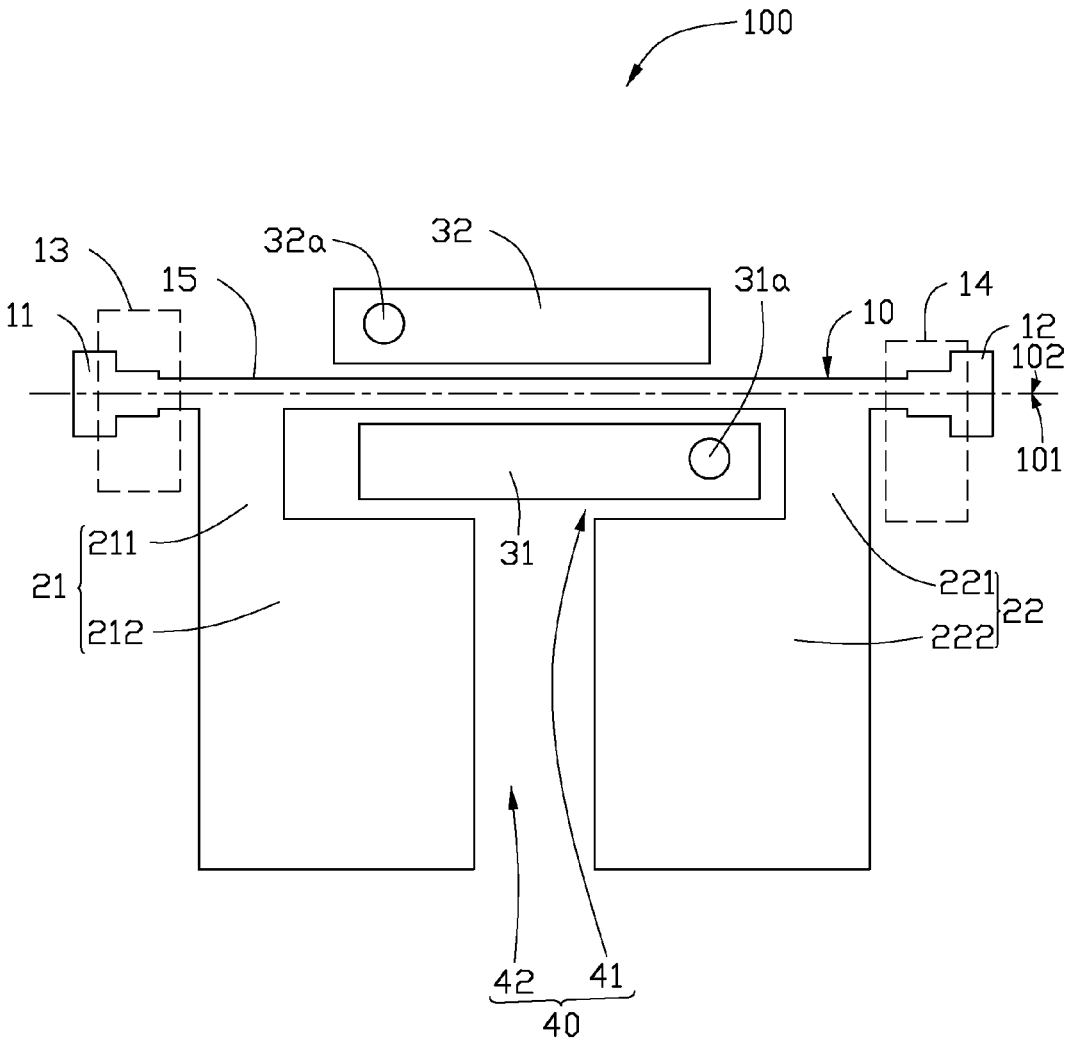
FIG. 1 is a schematic plan view of one embodiment of a low pass filter in accordance with the present disclosure.
Figure 2:
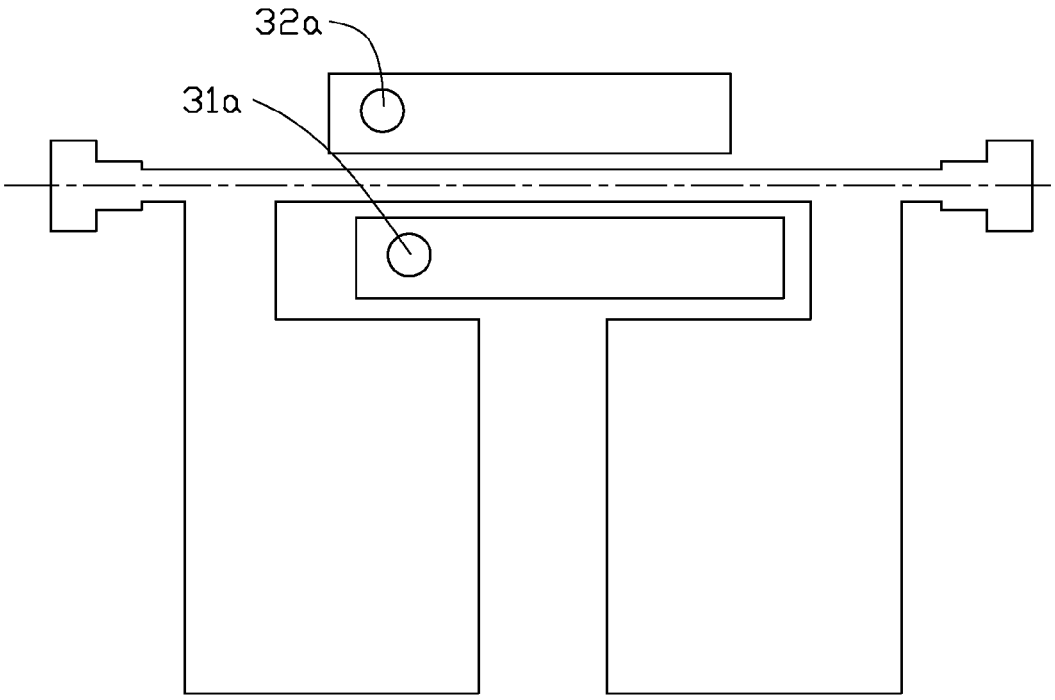
FIG. 2 is a schematic plan view of another embodiment of the low pass filter in accordance with the present disclosure.
Figure 3:
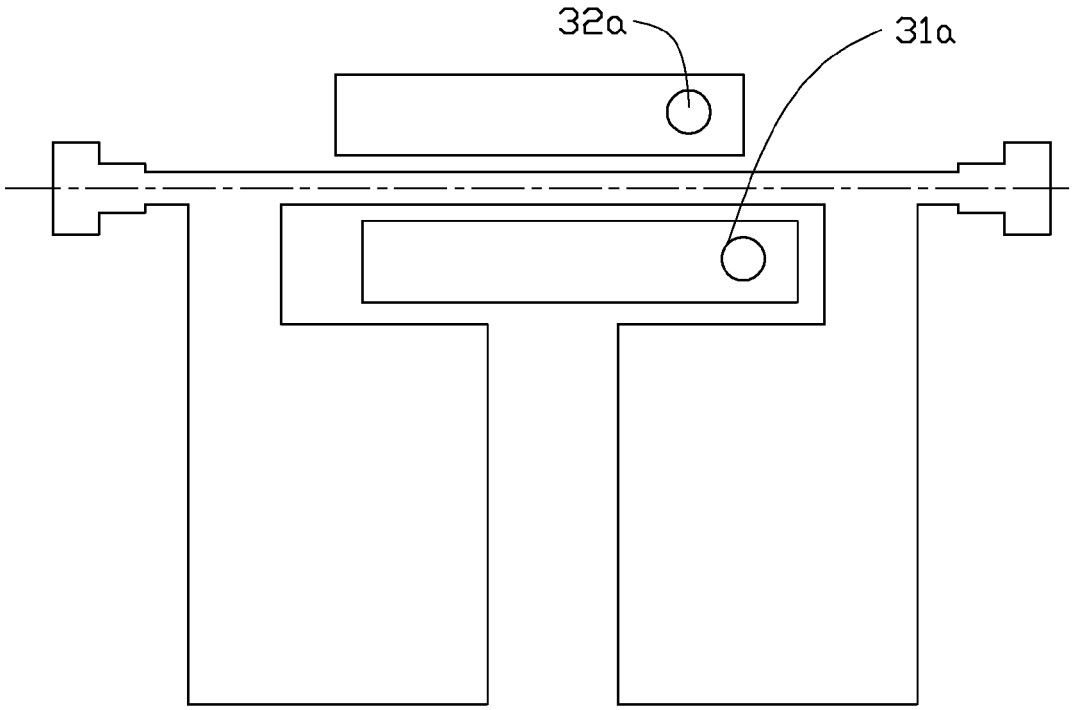
FIG. 3 is a schematic plan view of a further embodiment of the low pass filter in accordance with the present disclosure.
Figure 4:
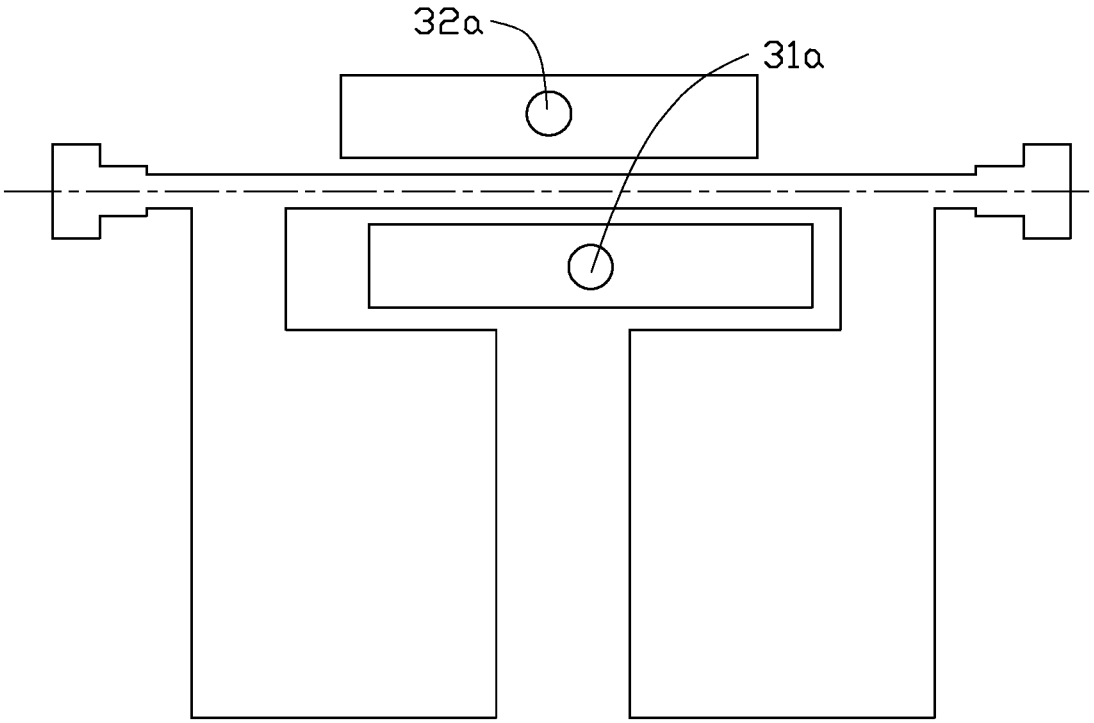
FIG. 4 is a schematic plan view of a further embodiment of the low pass filter in accordance with the present disclosure.
Figure 5:
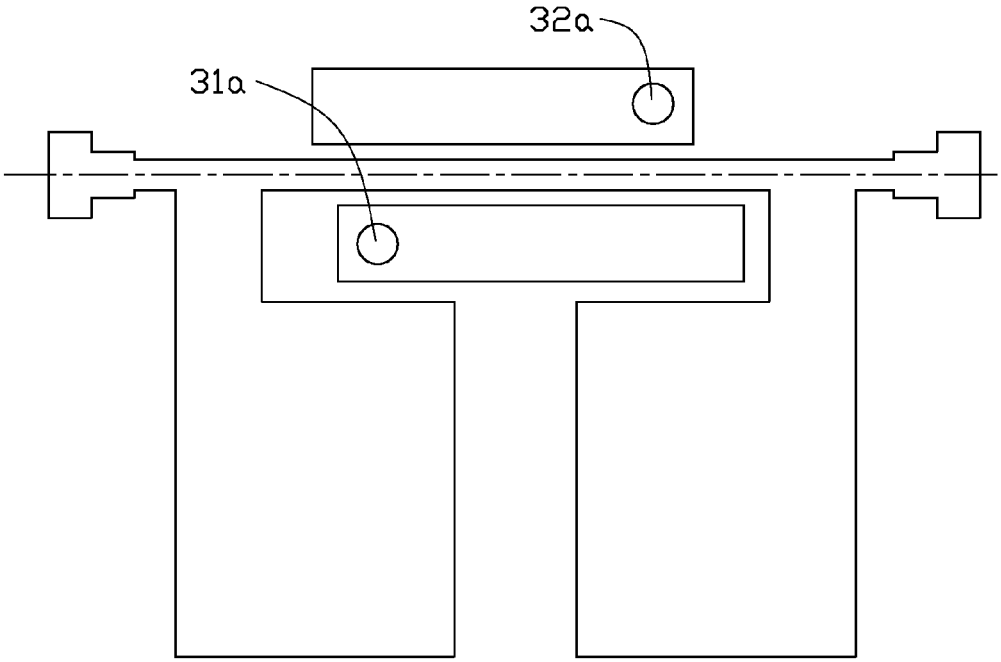
FIG. 5 is a schematic plan view of a further embodiment of the low pass filter in accordance with the present disclosure.
Figure 6:
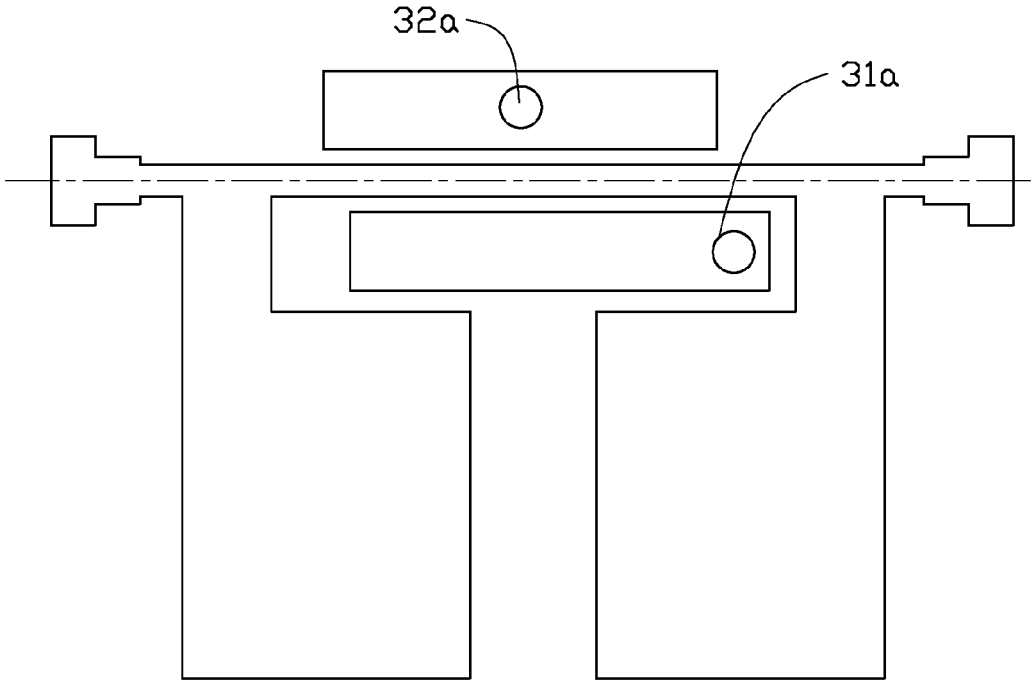
FIG. 6 is a schematic plan view of a further embodiment of the low pass filter in accordance with the present disclosure.

FIG. 1 is a schematic plan view of one embodiment of a low pass filter 100 in accordance with the present disclosure. In one embodiment, the low pass filter 100 includes a first port 11, a second port 12, a signal transmission line 10, a first open stub 21, a second open stub 22, a first coupling line 31, and a second coupling line 32.

The signal transmission line 10 is connected between the first port 11 and the second port 12, and is operable to transmit radio frequency (RF) signals from the first port 11 to the second port 12. In order to clearly describe the embodiment of the present disclosure, the signal transmission line 10 defines a first side 101 and a second side 102 opposite to the first side 101.

In one embodiment, the signal transmission line 10 includes a first matching portion 13, a main signal transmission portion 15, and a second matching portion 14 connected in sequence. The first matching portion 13 is connected between the first port 11 and the main signal transmission portion 15. The first matching portion 13 includes at least three microstrips with different widths, where the widths of the at least one microstrips are gradually narrowed from the first port 11 to the main signal transmission portion 15. The second matching portion 14 is connected between the main signal transmission portion 15 and the second port 12. The second matching portion 14 includes at least three microstrips with different widths, where the widths of the at least three microstrips are gradually widened from the main signal transmission portion 15 to the second port 12.

In one non-limiting example, a resistance of the first port 11 and a resistance of the second port 12 can be both about 50 Ohms, and a resistance of the main signal transmission portion 15 can be about 90 Ohms. It should be noted that a width of a microstrip is wider, a resistance of the microstrip is smaller, and vice versa. Thus, the first matching portion 13 transforms its resistance from 50 Ohms to 90 Ohms because the widths of the microstrips of the first matching portion 13 are gradually narrowed from the first port 11 to the main signal transmission portion 15. Similarly, the second matching portion 13 transforms its resistance from 90 Ohms to 50 Ohms because the widths of the microstrips of the second matching portion 14 are gradually widened from the main signal transmission portion 15 to the second port 12.

In one embodiment, widths of the microstrips of the first matching portion 13 and the second portion 14 are gradually changed (including narrowed and widened) via steps of FIG. 1. In other embodiments, the widths of the microstrips of the first matching portion 13 and the second portion 14 may also be gradually changed via a trapezoid or a triangle.

The first open stub 21 is disposed on the first side 101 of the signal transmission line 10 and perpendicularly connected to part of the signal transmission line 10 adjacent to the first port 11. The second open stub 22 is disposed on the first side 101 of the signal transmission line 10 and perpendicularly connected to another part of the signal transmission line 10 adjacent to the second port 12. The first open stub 21, the second open stub 22, and the signal transmission line 10 co-define a T-shaped gap 40. In one embodiment, the T-shaped gap 40 includes a first gap 41 shaped as a rectangle and a second gap 42 communicating with a middle of the first gap 41.

The first open stub 21 includes a rectangularly shaped first connection portion 211 and a rectangularly shaped first open portion 212. The first connection portion 211 is connected between the signal transmission line 10 and the first open portion 212, and a width of the first connection portion 211 is less than that of the first open portion 212.

The second open stub 22 includes a rectangularly shaped second connection portion 221 and a rectangularly shaped second open portion 222. The second connection portion 221 is connected between the signal transmission line 10 and the second open portion 222, and a width of the second connection portion 221 is less than that of the second open portion 222.

The first connection portion 211, the second connection portion 221, and the signal transmission line 10 co-define the first gap 41. The first open portion 212 and the second open portion 222 co-define the second gap 42.

The first coupling line 31 is parallel to the signal transmission line 10, and disposed in the T-shaped gap 41. The first coupling line 31 defines a first via 31*a*.

The second coupling line 32 is parallel to the signal transmission line 10 and disposed on the second side 102 of the signal transmission line 10. The second coupling line 32 defines a second via 32*a*.

In one embodiment, the first via 31*a* is disposed in one end of the first coupling line 31 adjacent to the second port 12, and the second via 32*a* is disposed in one end of the second coupling line 32 adjacent to the first port 11.

It should be noted that the low pass filter 100 of FIG. 1 has been presented by way of example only and not by way of limitation, the person in the art can change the low pass filter 100 in accordance with its equivalents. For example, referring to FIGS. 2-6, the first via 31*a* may be disposed in two ends or middle of the first coupling line 31, and the second via 32*a* may be disposed in two ends or middle of the second coupling line 32.

Figure 7:
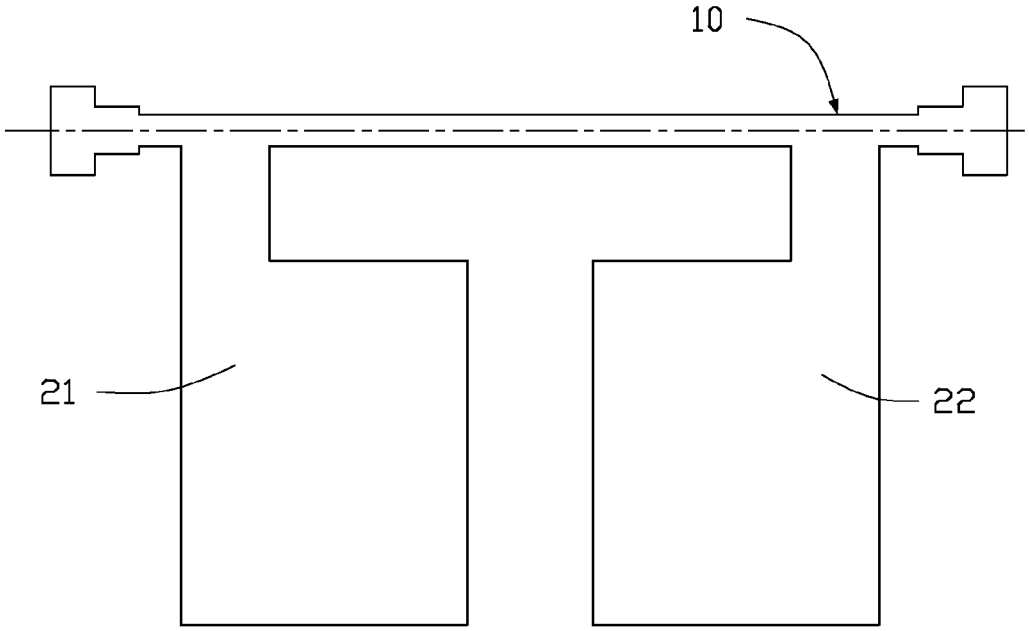
FIG. 7 is a schematic plan view of one embodiment of a $\pi$ filter of the low pass filter in accordance with the present disclosure.

In the low pass filter 100, the signal transmission line 10, the first open stub 21, and the second open stub 22 co-form a π filter of FIG. 7 which is used to filter a second harmonic.

Additionally, due to the first coupling line 31 with the first via 31*a* and the second coupling line 32 with the second via 32, the low pass filter 100 can filter a third harmonic.

Figure 8:
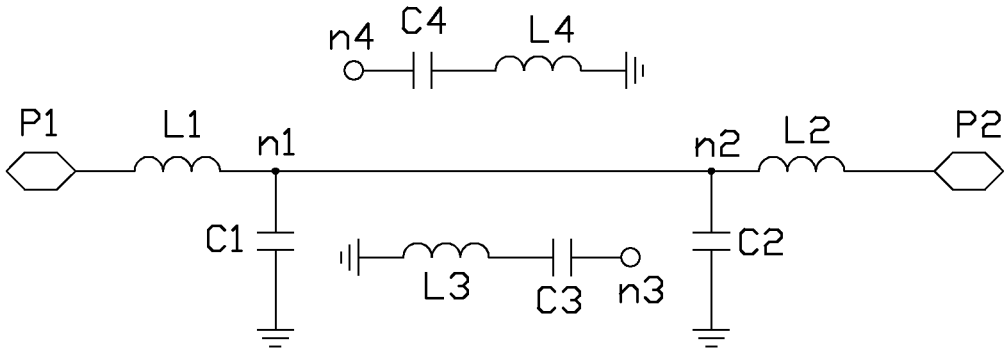
FIG. 8 is an equivalent circuit diagram of the low pass filter of FIG. 1.

FIG. 8 is an equivalent circuit diagram of the low pass filter 100 of FIG. 1. In one embodiment, the main signal transmission portion 15 may be a microstrip with a resistance of about 90 Ohms. The first port 11 and the second port 12 of FIG. 1 is respectively equivalent to the first port P1 and the second port P2 of FIG. 8. A resistance of the first port P1 and a resistance of the second port P2 are both equal to about 50 Ohms. The first matching portion 13 of FIG. 1 is equivalent to a first inductor L1 connected between the first port P1 and the main signal transmission portion 15. The first inductor L1 has a changeable resistance in order to match resistances between the first port P1 and the main signal transmission portion 15. The second matching portion 14 of FIG. 1 is equivalent to a second inductor L2 connected between the main signal transmission portion 15 and the second port P2. The second inductor L2 has a changeable resistance in order to match resistances between the main signal transmission portion 15 and the second port P2.

The first open stub 21 of FIG. 1 is equivalent to the first capacitor C1 of FIG. 8. One end of the first capacitor C1 is connected to main signal transmission portion 15 via a first node n1, and the other end of the first capacitor C1 is connected to a ground. The first capacitor C1 obtains a second harmonic from the main signal transmission portion 15 via the first node n1, and couples the second harmonic to the ground, so as to filter the second harmonic.

The second open stub 22 of FIG. 1 is equivalent to the second capacitor C2 of FIG. 8. One end of the second capacitor C2 is connected to main signal transmission portion 15 via a second node n2, and the other end of the second capacitor C2 is connected to the ground. The second capacitor C2 obtains the second harmonic from the main signal transmission portion 15 via the second node n2, and couples the second harmonic to the ground, so as to filter the second harmonic.

The first coupling line 31 with the first via 31*a* of FIG. 1 is equivalent to a third capacitor C3 and a third inductor L3 connected between a third node n3 and the ground. The third capacitor C3 and the third inductor L3 obtain a third harmonic from the main signal transmission portion 15 via the third node n3, and couple the third harmonic to the ground, so as to filter the third harmonic.

The second coupling line 32 with the second via 32*a* of FIG. 1 is equivalent to a fourth capacitor C4 and a fourth inductor L4 connected between a fourth node n4 and the ground. The fourth capacitor C4 and the fourth inductor L4 obtain the third harmonic from the main signal transmission portion 15 via the fourth node n4, and couple the third harmonic to the ground, so as to filter the third harmonic.

Figure 9:
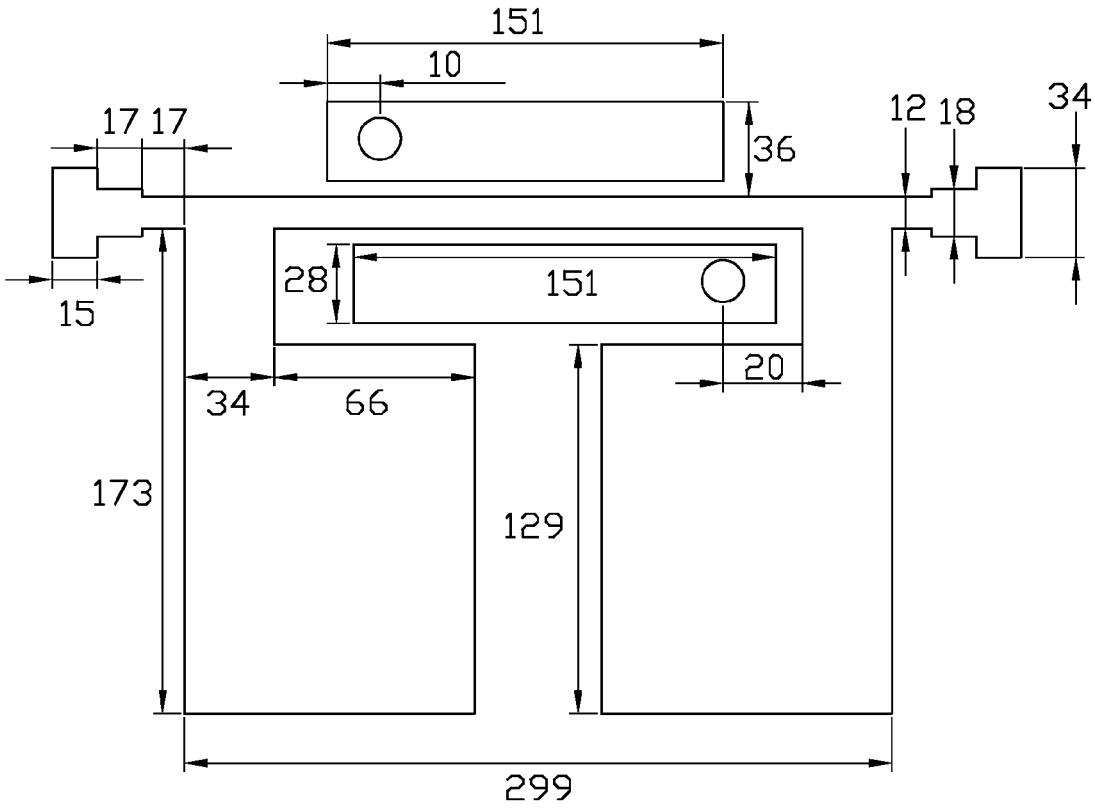
FIG. 9 is a schematic plan view illustrating dimensions of the low pass filter of FIG. 1.

FIG. 9 is a schematic plan view illustrating dimensions of the low pass filter 100 of FIG. 1. In one embodiment, only the dimensions of the first matching portion 13 are described because the first matching portion 13 and the second matching portion 14 are symmetrical along a perpendicular bisector of the main signal transmission portion 15. Widths of the first matching portion 13 are changed from 34 mil to 18 mil, and further to 12 mil. Lengths of the first matching portion 13 with widths of 34 mil, 18 mil, and 12 mil are respectively 15 mil, 17 mil, and 17 mil, in one exemplary embodiment.

Only the dimensions of the first open stub 21 including the first connection portion 211 and the first open portion 212 are described because the first open stub 21 and the second open stub 22 are symmetrical along the perpendicular bisector of the main signal transmission portion 15. A length of the first connection portion 211 can be (173−129) mil, and a width of the first connection portion 21 is 34 mil. A length of the first open portion 212 can be 129 mil, and a width of the first open portion 212 can be (34+66) mil.

A length of the first coupling line 31 is 151 mil, and a width of the first coupling line 31 can be 28 mil. A distance between a center of the first via 31*a* and the second connection portion 221 can be 20 mil. A length of the second coupling line 32 is 151 mil, and a width of the second coupling line 31 can be 28 mil. A distance between a center of the second via 32*a* and a side of the second coupling line 32 adjacent to the second via 32*a* is 10 mil.

Figure 10:
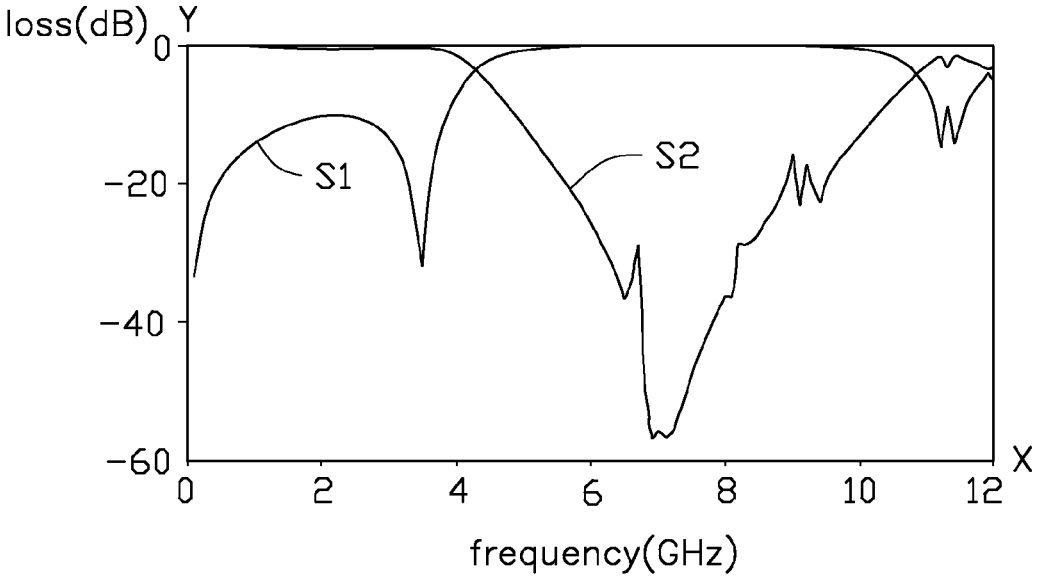
FIG. 10 is a graph of test results showing an insertion loss and a return loss of the $\pi$ filter of the low pass filter of FIG. 1.

FIG. 10 is a graph of test results showing an insertion loss and a return loss of the π filter (shown in FIG. 7) of the low pass filter 100 of FIG. 1. In one embodiment, the π filter shown in FIG. 7 is operated in a WIMAX frequency of 3.5 GHz. In the communication industry principle, a return loss of the operating frequency (3.5 GHz) must be below −10 dB, an insertion loss of a second harmonic (7.0 GHz) must be below −40 dB, and an insertion loss of a third harmonic (10.5) must be below −20 dB.

A first graph S1 of FIG. 10 indicates a return loss of the π filter shown in FIG. 7, and a second graph S2 of FIG. 10 indicates an insertion loss of the π filter shown in FIG. 7. As shown in the first graph S1, when the operating frequency is equal to 3.5 GHz, the return loss is below −10 dB, indicating that radio frequency (RF) signals of 3.5 GHz can be transmitted from the first port 11 to the second port 12. When the operating frequency is equal to 7.0 GHz-10.5 GHz, the return loss is about 0 dB, indicating that RF signals of 7.0 GHz~10.5 GHz cannot be transmitted from the first port 11 to the second port 12.

As shown in the second graph S2, when the operating frequency is 3.6 GHz, the insertion loss is about −0.44 dB, indicating that the RF signals of 3.5 GHz-3.6 GHz is not filtered. When the operating frequency is 6.8 GHz-7.2 GHz, the insertion loss is about −49.69 dB~−55.89 dB (below −40 dB), indicating that the second harmonic of 6.8 GHz-7.2 GHz is filtered. When the operating frequency is 10.20 GHz-10.80 GHz, the insertion loss is about −10.72 dB~−4.45 dB (above −20 dB), indicating that the third harmonic of 10.20 GHz-10.80 GHz is not filtered. Thus, the π filter shown in FIG. 7 can filter the second harmonic, but cannot filter the third harmonic.

Figure 11:
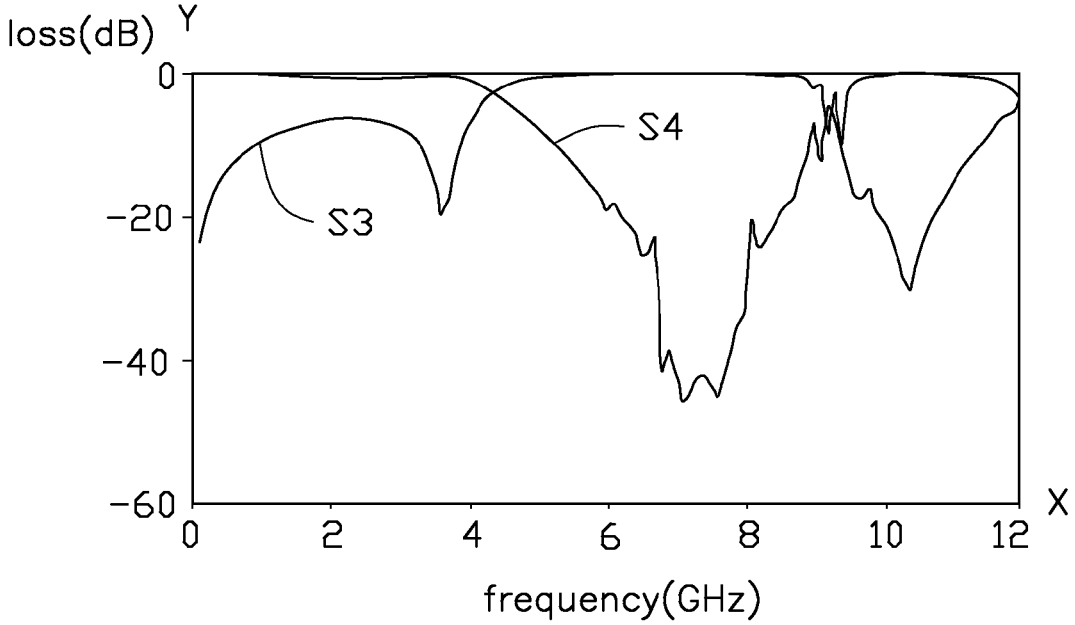
FIG. 11 is a graph of test results showing an insertion loss and a return loss of the low pass filter of FIG. 1.

FIG. 11 is a graph of test results showing an insertion loss and a return loss of the low pass filter of FIG. 1. In one embodiment, the low pass filter 100 of FIG. 1 is operated in WiMAX frequency of 3.5 GHz.

A third graph S3 of FIG. 11 indicates a return loss of the low pass filter of FIG. 1, and a fourth graph S4 of FIG. 11 indicates an insertion loss of the low pass filter of FIG. 1. As shown in the third graph S3, when the operating frequency is equal to 3.5 GHz, the return loss is below −10 dB, indicating that radio frequency (RF) signals of 3.5 GHz can be transmitted from the first port 11 to the second port 12. When the operating frequency is equal to 7.0 GHz-10.5 GHz, the return loss is about 0 dB, indicating that RF signals of 7.0 GHz~10.5 GHz cannot be transmitted from the first port 11 to the second port 12.

As shown in the fourth graph S4, when the operating frequency is 3.6 GHz, the insertion loss is about −0.37 dB, indicating that the RF signals of 3.5 GHz~3.6 GHz is not filtered. When the operating frequency is 6.8 GHz-7.2 GHz, the insertion loss is about −55.94 dB~−59.97 dB (below −40 dB), indicating that the second harmonic of 6.8 GHz~7.2 GHz is filtered. When the operating frequency is 10.20 GHz-10.80 GHz, the insertion loss is about −33.75 dB~−22.98 dB (below −20 dB), indicating that the third harmonic of 10.20 GHz-10.80 GHz is filtered. Thus, the low pass filter 100 of FIG. 1 can filter both the second harmonic and the third harmonic.

While various embodiments and methods of the present disclosure have been described above, it should be understood that they have been presented by way of example only and not by way of limitation. Thus the breadth and scope of the present disclosure should not be limited by the above-described embodiments, but should be defined only in accordance with the following claims and their equivalents.

What is claimed is:

1. A low pass filter, comprising:

a first port;

a second port;

a substantially linear strip shaped signal transmission line connected between the first port and the second port, and operable to transmit radio frequency signals from the first port to the second port, the signal transmission line defining a first side and a second side opposite to the first side;

a first open stub disposed on the first side of the signal transmission line and perpendicularly connected to a part of the signal transmission line adjacent to the first port;

a second open stub disposed on the first side of the signal transmission line and perpendicularly connected to another part of the signal transmission line adjacent to the second port, the second open stub and the first open stub co-defining a T-shaped gap;

a first coupling line parallel to the signal transmission line and disposed in the T-shaped gap, the first coupling line defining a first via; and a second coupling line parallel to the signal transmission line and disposed on the second side of the signal transmission line, the second coupling line defining a second via.

2. The low pass filter of claim 1, wherein the first open stub comprises:

a rectangularly shaped first connection portion; and a rectangularly first open portion;

wherein the first connection portion is connected between the signal transmission line and the first open portion, and a width of the first connection portion is less than that of the first open portion.

3. The low pass filter of claim 2, wherein the second open stub comprises:

a rectangularly shaped second connection portion; and a rectangularly shaped second open portion;

wherein the second connection portion is connected between the signal transmission line and the second open portion, and a width of the second connection portion is less than that of the second open portion.

4. The low pass filter of claim 3, wherein the first connection portion, the second connection portion, and the signal transmission line co-define a first gap, and the first open portion and the second open portion co-define a second gap.

5. The low pass filter of claim 4, wherein the first gap and the second gap co-form the T-shaped gap.

6. The low pass filter of claim 1, wherein the signal transmission line comprises a first matching portion, a main signal transmission portion, and a second matching portion connected in sequence.

7. The low pass filter of claim 6, wherein the first matching portion is connected between the first port and the main signal transmission portion, and comprises at least three microstrips with different widths, and the different widths of the at least three microstrips are gradually narrowed from the first port to the main signal transmission portion.

8. The low pass filter of claim 6, wherein the second matching portion is connected between the main signal transmission portion and the second port, and comprises at least three microstrips with different widths, and the different widths of the at least three microstrips are gradually widened from the main signal transmission portion to the second port.

9. The low pass filter of claim 1, wherein the first via is disposed in a selective one of two ends and a middle of the first coupling line, and the second via is selectively disposed in one of two ends and a middle of the second coupling line.

10. The low pass filter of claim 9, wherein the first via is disposed in one of the two ends of the first coupling line adjacent to the second port, and the second via is disposed in one of the two ends of the second coupling line adjacent to the first port.

11. The low pass filter of claim 1, wherein long edges of the first coupling line are parallel to the signal transmission line, long edges of the second coupling line are parallel to the signal transmission line.

12. A low pass filter, comprising:

a first port;

a second port;

a substantially linear strip shaped signal transmission line connected between the first port and the second port, and operable to transmit radio frequency signals from the first port to the second port, the signal transmission line defining a first side and a second side opposite to the first side;

a first open stub disposed on the first side of the signal transmission line and perpendicularly connected to a part of the signal transmission line adjacent to the first port, the first open stub comprising a first connection portion and a first open portion, the first connection portion is connected between the signal transmission line and the first open portion;

a second open stub disposed on the first side of the signal transmission line and perpendicularly connected to another part of the signal transmission line adjacent to the second port, the second open stub comprising a second connection portion and a second open portion, wherein the second connection portion is connected between the signal transmission line and the second open portion, wherein the first connection portion, the second connection portion, and the signal transmission line co-define a first gap, and the first open portion and the second open portion co-define a second gap, the first gap and the second gap co-form a T-shaped gap;

a first coupling line disposed in the T-shaped gap; and a second coupling line disposed on the second side of the signal transmission line.

13. The low pass filter of claim 12, wherein the first connection portion, the first open portion, the second connection portion, and the second open portion are a rectangular shape, respectively.

14. The low pass filter of claim 13, wherein a width of the first connection portion is less than that of the first open portion, and a width of the second connection portion is less than that of the second open portion.

15. The low pass filter of claim 12, wherein the first coupling line parallels to the signal transmission line, the second coupling line parallels to the signal transmission line.

16. The low pass filter of claim 12, wherein the first coupling line defines a first via, the second coupling line defines a second via, to filter the third harmonic.

* * * * *